US006126031A

United States Patent [19]

Reason

[11] Patent Number: 6,126,031

[45] Date of Patent: Oct. 3, 2000

[54] SACK DISPENSING WASTE CONTAINER

[76] Inventor: Richard E. Reason, P.O. Box 678, 613 Bowman Ave., Woodland Park, Colo. 80906

[21] Appl. No.: 08/868,377

[22] Filed: Jun. 3, 1997

[51] Int. Cl.[7] ..... B65F 1/06

[52] U.S. Cl. ..... 220/495.07; 220/495.11; 220/495.04; 220/501; 220/908.1

[58] Field of Search ..... 220/407, 404, 220/908, 529, 554, 527, 495.07, 495.06, 495.01, 495.11, 495.04, 501, 503, 505, 908.1, 909, 553, 555, 676

[56] References Cited

U.S. PATENT DOCUMENTS

| | | | |
|---|---|---|---|
| 3,392,825 | 7/1968 | Gale et al. | 220/407 |
| 3,451,453 | 6/1969 | Heck | 220/495.07 |
| 3,800,503 | 4/1974 | Maki | 220/495.07 |
| 4,294,379 | 10/1981 | Bard | 220/908 |
| 4,349,123 | 9/1982 | Yang | 220/407 |
| 4,715,572 | 12/1987 | Robbins, III et al. | 220/908 |
| 4,964,523 | 10/1990 | Bieltvedt et al. | 220/495.06 |
| 5,165,654 | 11/1992 | Prout et al. | 220/908 |
| 5,246,151 | 9/1993 | Jabara | 220/529 |
| 5,271,520 | 12/1993 | McAfee | 220/529 |
| 5,628,424 | 5/1997 | Gola | 220/495.07 |
| 5,632,401 | 5/1997 | Hurd | 220/908.1 |

*Primary Examiner*—Stephen Castellano

[57] ABSTRACT

A waste container which automatically dispenses and positions a sack within the waste container when an existing sack, full of waste is removed from the waste container is disclosed. One aspect of the invention is an adaption to dispense a roll sacks into a conventional waste container of the type having a side wall, a top rim, and a lower bottom wall 30. The adaption comprises: an upper bottom wall extending across an interior of the container so that a sack holding compartment is formed in the bottom portion of the container, with upper bottom wall having a central sack outlet opening therethrough; and, a sack inlet access opening into the bag holding compartment to permit insertion of unopened sacks therethrough. A second aspect of the invention provides for an upper bottom wall insert for a conventional waste container to facilitate storage and dispensing of unopened sacks into the container. The insert comprises: an upper bottom wall sized to fit closely within the waste container having a central sack outlet opening therethrough; and, spacing means to support the upper bottom wall at a spaced distance above a bottom side portion of the container.

8 Claims, 1 Drawing Sheet

SACK DISPENSING WASTE CONTAINER

FIELD OF INVENTION

This invention relates to waste containers used in conjunction with plastic sacks lining their interior side portion. More particularly this invention relates to a waste container which automatically dispenses and positions a sack within the waste container when an existing sack, full of waste is removed from the waste container.

BACKGROUND OF THE INVENTION

Waste containers are frequently used in conjunction with plastic sacks lining their interior side portion then, when the container needs to be emptied, one need only lift out the full sack and tie it closed. This eliminates the need to touch the waste. It also ensures that the waste container remains clean. It saves considerable time.

Individuals dispose of waste in their homes probably on a weekly basis. Hotels and businesses may empty their waste containers on a daily basis. Hospital operating rooms empty their waste containers on an hourly basis. In many businesses waste containers are scheduled to be regularly emptied for sanitary reasons. There is a need for a sack dispensing waste container that positions the sacks within the waste container. Such a container would promote sanitation, eliminate sustained bending, and considerably reduce time spent performing an unpleasant chore.

One aspect of this invention provides for an improvement and adaption to dispense sacks from a waste container of the type having a side wall, a top rim, and a lower bottom wall. The improvement comprises: an upper bottom wall extending across an interior of the container so that a sack holding compartment is formed in the bottom portion of the container, said upper bottom wall having a central sack outlet opening therethrough; and, a sack inlet access means into the bag holding compartment to permit insertion of unopened sacks therethrough.

Another aspect of this invention provides for an upper bottom wall insert for a conventional waste container to facilitate storage and dispensing of unopened sacks into the container comprising: an upper bottom wall sized to fit closely within the waste container having a central sack outlet opening therethrough; and, spacing means to support the upper bottom wall at a spaced distance above a bottom side portion of the container.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 2:
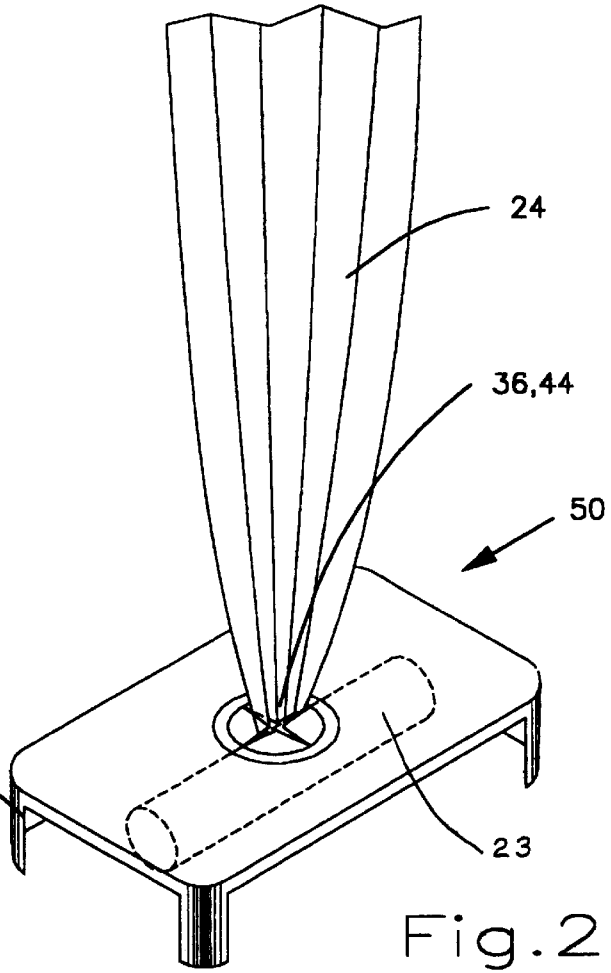
FIG. 2 is an enlarged perspective view of an upper bottom wall insert sized to fit closely within a conventional waste container.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
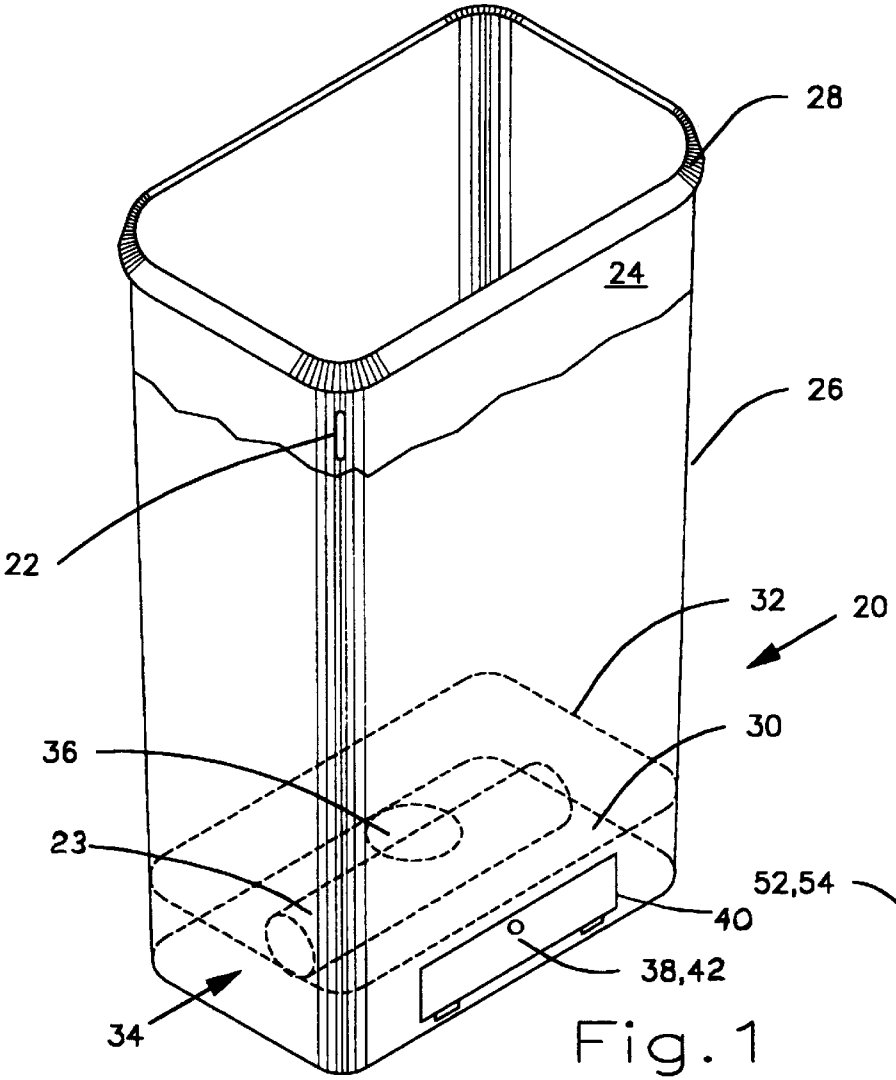
FIG. 1 is a perspective view of a sack dispensing waste container having a top vent.

Turning now to the drawings and more particularly to FIG. 1 we have a perspective view of a sack dispensing waste container 20 having a top vent 22. The sack dispensing waste container 20 is an improvement and adaption to dispense sacks 24 from a conventional waste container 20 of the type having a side wall 26, a top rim 28, and a lower bottom wall 30. The improvement comprises: an upper bottom wall 32 extending a across an interior of the container 20 so that a sack holding compartment 34 is formed beneath the upper bottom wall 32, said upper bottom wall 32 having a central sack outlet opening 36 therethrough; and, a sack inlet access means 38 into the bag holding compartment 34 to permit insertion of unopened sacks 24 therethrough.

Most preferably the sack inlet access means 38 comprises an inlet opening 40 covered by a hinged door 42 in a sidewall 26 of the bag holding compartment 34 in the container 20. The waste container 20 is preferably made from plastic. It has been found that an air vent 44 through the side wall 26 beneath the top rim 28 is useful to facilitate expansion of a sack 24 having its top portion pulled over the top rim 28. This air vent 44 helps prevent the sack 24 from sliding off of the top rim 28 when waste (not shown)is thrown into a partially closed sack 24. When the container 20 is generally rectangular the air vents 22 are positioned through the vertical arrises thereof. The sack outlet opening 36 preferably is provided with a flexible closing diaphragm 44 having a lateral cut thereacross (see FIG. 2).

FIG. 2 is an enlarged perspective view of a upper bottom wall insert 50 sized to fit closely within a conventional waste container 20. The upper bottom wall insert 50 facilitates storage and dispensing of unopened sacks 24 into the container 20. Most generally the insert 50 comprises: an upper bottom wall 32 having a central sack outlet opening 36 therethrough; and, spacing means 52 to support the upper bottom wall 32 at a spaced distance above a bottom side portion 30 of the container 20. Most preferably the spacing means 52 comprises leg members 54 extending downwardly from the upper bottom wall 32.

In the most preferred embodiment the upper bottom wall 32 is generally rectangular and has four legs 54, one on each corner portion thereof. The insert may be sized to fit snugly within the container 20 so that it will remain in position when sacks 24 are pulled up through the outlet opening 36 therein. The insert 50 is made of plastic. A flexible closing diaphragm 44 having a lateral cut thereacross may be provided.

While initially the insert was sized to fit within an eight gallon waste container 20, it will be appreciated that the principle of the insert 50 is applicable to all sizes of waste containers 20.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. In a waste container of the type having a side wall, a top rim, a lower bottom wall, an upper bottom wall extending a across an interior of the container so that a sack holding compartment is formed beneath the upper bottom wall, said upper bottom wall having a central sack outlet opening having a flexible closing diaphragm having a lateral cut thereacross to hold a sack pulled through the outlet opening in position; and, a sack inlet access means into the sack holding compartment to permit insertion of unopened sacks therethrough, the method of dispersing sacks into the container comprising the following steps:

a) inserting a roll of sacks through the inlet access means into the bag holding compartment;

b) unrolling a sack from the roll and pulling it upwardly through the central opening into the interior of the container; and, c) pulling a top portion of the sack over the top rim of the container;

so that when the sack is filled with waste it may be lifted up out of the container automatically pulling a next sack from the roll through the central opening, into the container and positioning a top portion of the next sack above the top rim of the container so that it may be pulled thereover, ready for use.

2. A method as in claim 1 wherein the sack inlet access means comprises an inlet opening in the sack holding compartment.

3. A method as in claim 2 wherein the sack inlet access means further comprises a hinged door covering the inlet opening.

4. A method as in claim 3 wherein the inlet opening is in a sidewall of the container.

5. A waste method as in claim 4 wherein the container is made from plastic.

6. A method as in claim 1 further comprising air vents through the side walls immediately beneath the top rim to facilitate expansion of the sack having its top portion pulled over the top rim as it is filled with waste.

7. A method as in claim 6 wherein the container is generally rectangular and the air vents are positioned through the vertical arrises thereof.

8. A method of dispensing sacks into a generally rectangular container having a side wall, a top rim, a lower bottom wall, an upper bottom wall extending a across an interior of the container so that a sack holding compartment is formed in the bottom portion of the container, said upper bottom wall having a central sack outlet opening therethrough having a flexible closing diaphragm having a lateral cut thereacross; and, said side wall having an air vents positioned through a vertical arris thereof to facilitate expansion of a sack having its top portion pulled over the top rim; a sack inlet access means into the sack holding compartment to permit insertion of unopened sacks therethrough, comprising the following steps:

a) inserting a roll of sacks through the inlet access means into the bag holding compartment;

b) unrolling a sack from the roll and pulling it upwardly through the central opening into the interior of the container; and, c) pulling a top portion of the sack over the top rim of the container;

so that as the sack expands as it is filled with waste air is channelled up the arrises and out the air vents and the top portion of the sack remains pulled over the top rim of the container;

so that when the sack is filled with waste it may be lifted up out of the container automatically pulling a next sack from the roll through the central opening, into the container and positioning a top portion of the next sack above the top rim of the container so that it may be pulled thereover, ready for use.

* * * * *